US006327823B1

(12) United States Patent
Emms

(10) Patent No.: US 6,327,823 B1
(45) **Date of Patent: *Dec. 11, 2001**

(54) JOINTING DEVICE

(75) Inventor: Philip John Emms, Whiterock (AU)

(73) Assignee: Emms Investments PTY Ltd., Queensland (AU)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/393,685

(22) Filed: Sep. 10, 1999

(51) Int. Cl.[7] ..... E04B 7/04

(52) U.S. Cl. ..... 52/93.2; 52/93.1; 52/222; 52/273; 52/639; 52/643; 52/712; 52/732.1

(58) Field of Search ..... 52/93.1, 93.2, 52/712, 222, 273, 639, 643, 732.1

(56) References Cited

U.S. PATENT DOCUMENTS 1,652,612 12/1927 Daniels .
5,660,005 * 8/1997 Tacoma ..... 52/93.2

FOREIGN PATENT DOCUMENTS

24889/95 1/1997 (AU) .
42890/97 5/1998 (AU) .
614005 10/1979 (CH) .
2142278 3/1973 (DE) .
2951098 7/1980 (DE) .
1493599 11/1977 (GB) .

* cited by examiner

*Primary Examiner*—Beth A. Stephan
*Assistant Examiner*—Christy M. Syres
(74) *Attorney, Agent, or Firm*—Young & Thompson

(57) ABSTRACT

A jointing device (10) is provided for joining elongate members (106, 110), and 108, 112) in a building (100). The device (10) is formed form a blank (11) of sheet material and comprises a gusset portion (12) and spaced flange portion (14 and 16) each extending from an edge of the gusset portion (12) and forming a cavity there between. The device (10) further comprises a first opening (24) arranged adjacent to one end of the gusset portion and in communication with the cavity and a second opening (26) arranged adjacent to the opposite end of the gusset portion and in communication with the cavity. In use, one elongate member (106) is positioned in the cavity through the first opening (24) and a second elongate member (110) is positioned in the cavity through the second opening (26) for joining by fixing to the jointing device (10). The blank (11) has foldlines (70) and the blank (11) is configured with sections bendable along the foldlines to form the gusset portion (12) and the flange portions (14 and 16).

12 Claims, 7 Drawing Sheets

JOINTING DEVICE

TECHNICAL FIELD OF THE INVENTION

This invention relates to a jointing device for joining elongated members of a building structure and in particular but not limited to a jointing device for joining an upright member and a truss member, or for joining adjacent truss members of a portal frame structure.

BACKGROUND OF THE INVENTION

Buildings generally have a number of elongate structural members that are joined together. For example, roof trusses are joined together at their apex and to respective uprights.

It is observed that elongate structural members are joined by plate-shaped jointing devices to one side of the structural members.

The joints so formed are structurally weak and prone to failures.

Where the elongate members are C-shaped steel sections, the plate-shaped jointing devices are invariably fixed to the bight portions of the sections. The open side of the C-sections can be deformed easily.

The ends of the elongate members at the joints are exposed and must be shaped by cutting or otherwise in order to have an acceptable appearance.

One attempt to improve structural strength at the joints is to provide the plate-shaped devices with lips forming shallow channels for receiving the elongate members. These devices do not totally overcome the above disadvantages as the joints continue to be structurally weak.

More importantly, these prior art devices require the elongate members for joining to be physically held together while fixing a jointing device thereto. At least one additional worker or a expensive hold-down tool must be employed for holding the elongate members together.

The jointing devices currently available do not have facility for a roof truss member to extend outwardly as an eave support.

OBJECT OF THE PRESENT INVENTION

An object of the present invention is to alleviate or to reduce to a certain level one or more of the prior art disadvantages.

OUTLINE OF THE INVENTION

In one aspect therefore the present invention relates to a jointing device for joining elongate members. The device comprises a gusset portion and spaced flange portion each extending from an edge of the gusset portion and forming a cavity there between. The device further comprises a first opening arranged adjacent to one end of the gusset portion and in communication with the cavity and a second opening arranged adjacent to the opposite end of the gusset portion and in communication with the cavity. In use, one elongate member is positioned in said cavity through said first opening and a second elongate member is positioned in said cavity through said second opening for joining by fixing to the jointing device. The device is formed from a blank with foldlines and the blank is configured with sections bendable along said foldlines to form said gusset portion and said flange portions.

In preference, at least one of flange portions has one or more skirt elements formed remotely from said gusset portion and extending in a direction towards the opposite flange portion. It is further preferred that the one or more skirt elements extends to the opposite flange portion. If desired the or each skirt element may be integrally formed with the flange portions.

More preferably said at least one flange portion has two skirt elements arranged for, in use, abutting respective elongate members.

Desirably the flange portions are configured so that the first opening and said second opening are aligned or at an angle to each other.

The device may be formed with means for facilitating fixing to the elongate members. Suitably said facilitating means are guide holes for fixing means such as nails, bolts, nuts, screws, staples or the like.

It is preferred that the gusset portion extends substantially between the first and second openings. It is further preferred that the gusset portion extends to the openings so that, in use, the elongate members are in contact with free ends of the gusset portions.

Said elongate members may be solid, hollow or a combination thereof. They may be in the form of a C or U sections, or T or I sections, or a combination thereof. Each said elongate member may have two of said sections positioned back to back.

One or each of the flange portions may have a part which can be removed for providing access to fixing the device to or removing the device from one of the elongate members.

Conveniently the device has a third opening in alignment with the first opening so that the elongate member through the first opening can extend outwardly through the third opening to form an eave support structure.

One or both said flange portions may have one or more observation holes for checking the elongate members in the cavity thereof.

In another aspect therefore the present invention resides in a building structure comprising at least one pair of spaced upright elongate members and one or more roof truss elongate members spanning the or each pair of the elongate members. Each of the upright elongate member is joined to the or each said roof truss elongate members by the device as hereinbefore described.

It is preferred that where the building structure includes two or more roof truss elongate members, adjacent roof truss elongate members are joined by the device as hereinbefore described.

The building structure may be a portal frame structure for a carport, garage, shed, dwelling or the like buildings.

BRIEF DESCRIPTION OF THE DRAWINGS

In order that the present invention can be readily understood and put into practical effect the description will now refer to the accompanying drawings which illustrate non-limiting embodiments of the present invention, and wherein.

DETAILED DESCRIPTION OF THE DRAWINGS

Figure 1:
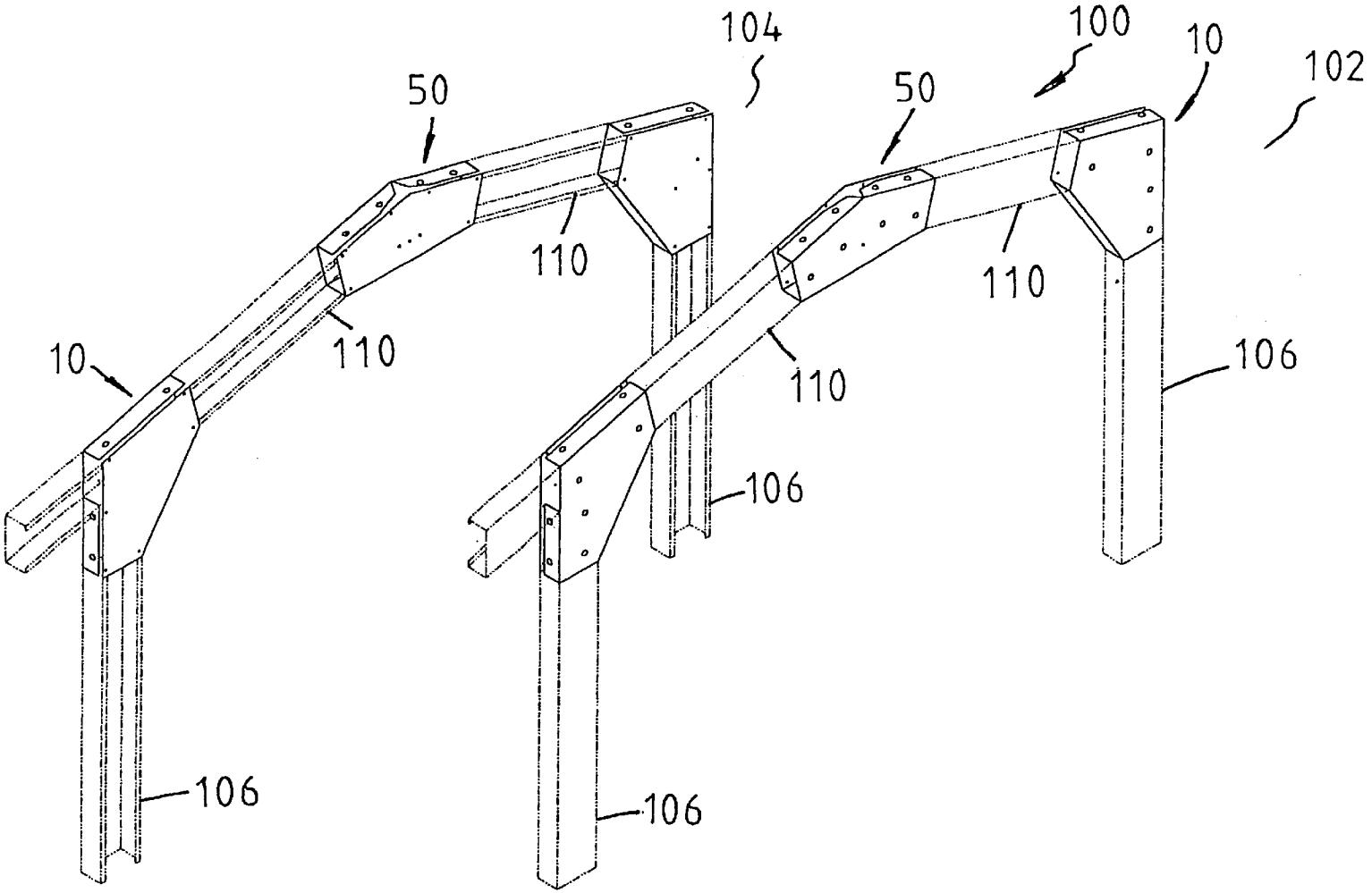
FIG. 1 is a perspective view of a partial portal building structure employing embodiments of the jointing device according to the present invention.

Referring initially to FIG. 1 there is shown a partial view of a portal building structure 100 having a first frame structure 102 and a second frame structure 1 04.

Each of the frame structures 102 and 104 has a pair of spaced elongate upright members which in this case are C-section leg purlins 108 and a pair of roof truss elongate member which in this case are C-section roof truss 110.

The paired leg purlins 106, 108 are joined to respective roof purlins 110, by an embodiment of the knee jointing device 10 according to the present invention. The paired roof truss purlins 110 are joined together by an embodiment of the apex jointing device 50 according to the present invention.

While not shown, it should be understood that fixing means such as screws, bolts, rivets and the like can be used to fix the devices 10 and 50 to the leg purlins 106 and the roof truss purlins 110. Performed fixing apertures are provided on the devices 10 and 50 for the fixing means.

Referring now to FIGS. 2 to 5 in conjunction with FIG. 1, each knee jointing device 10 has a gusset portion 12, spaced flange portions 14, 16 extending from one side of the gusset portion 12 and skirt elements 18 and 20 extending from the flange portion 14 to a portion just short of the opposite flange portion 16.

As mentioned earlier, preformed fixing apertures 22 are provided on predetermined positions on the flange portions 14,16 and the skirt elements 18, 20 for joining to the purlins 110 by fixing means.

The knee jointing device 10 as shown has a first opening 24 for a roof truss purlin 110 to enter the interior of the device 10 a second opening 26 for a leg purlin 106, to enter the interior, and a third opening 28 for the roof truss purlin 110 to extend through the device 10 to form an eave support as shown in FIG. 1.

Figure 4:
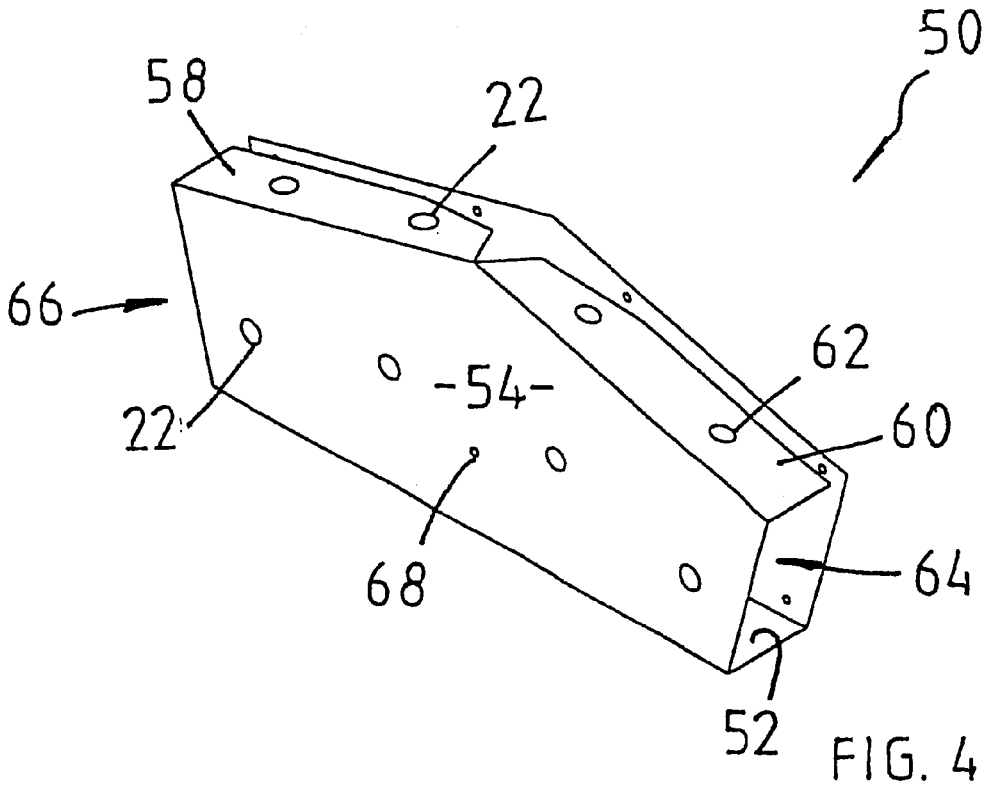
FIGS. 4 and 5 are respective isometric view from front and back of the jointing device for an apex joint shown in FIG. 1.
Figure 5:
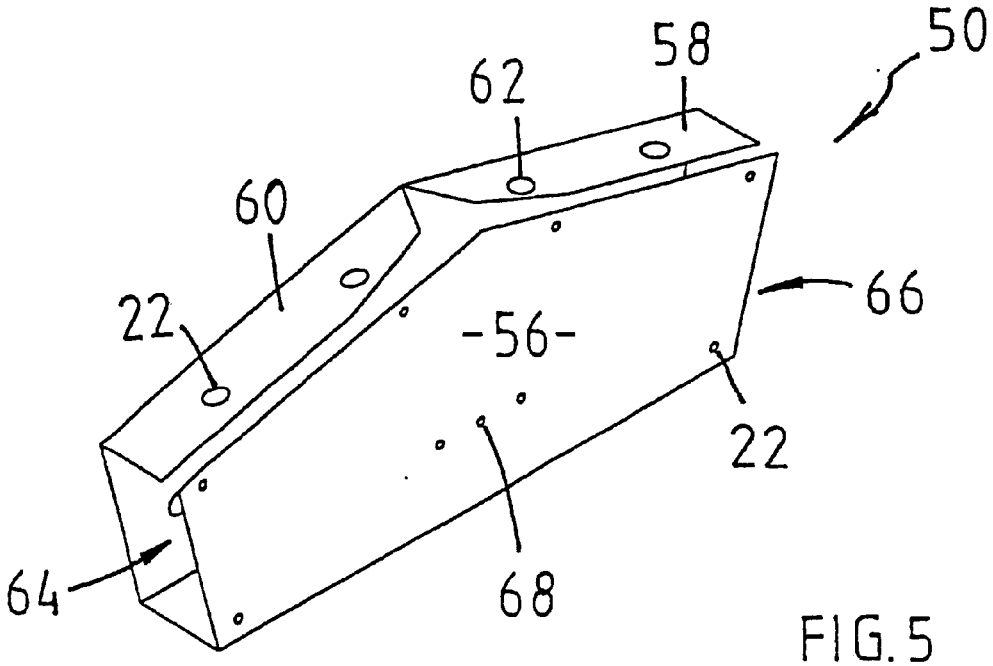

The apex jointing device 50 shown in FIGS. 4 and 5 has a gusset portion 52, spaced flanges 54, 56, each extending from one side of the gusset portion 52 and skirt elements 58, 60 extending from the flange portion 54 to a position just short of the opposite flange portion 56.

As for the knee jointing device 10, fixing apertures 22 are provided for guiding fixing means for fixing the apex jointing device 50 to the roof truss purlins 110 which enter the interior of the device 50 through openings 64 and 66.

The apex jointing device 50 is also provided with observation holes 68 on the flange portions 54, 56 so that an operator see the positions of the truss purlins 110 within the interior of the device 50.

Figure 2:
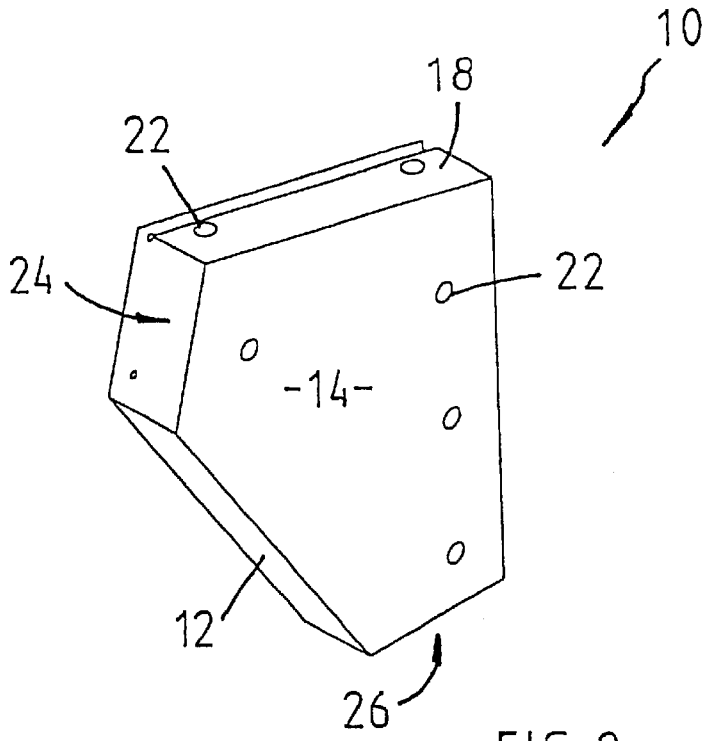
FIGS. 2 and 3 are respective isometric views from front and back of the jointing device for a knee joint shown in FIG. 1.
Figure 3:
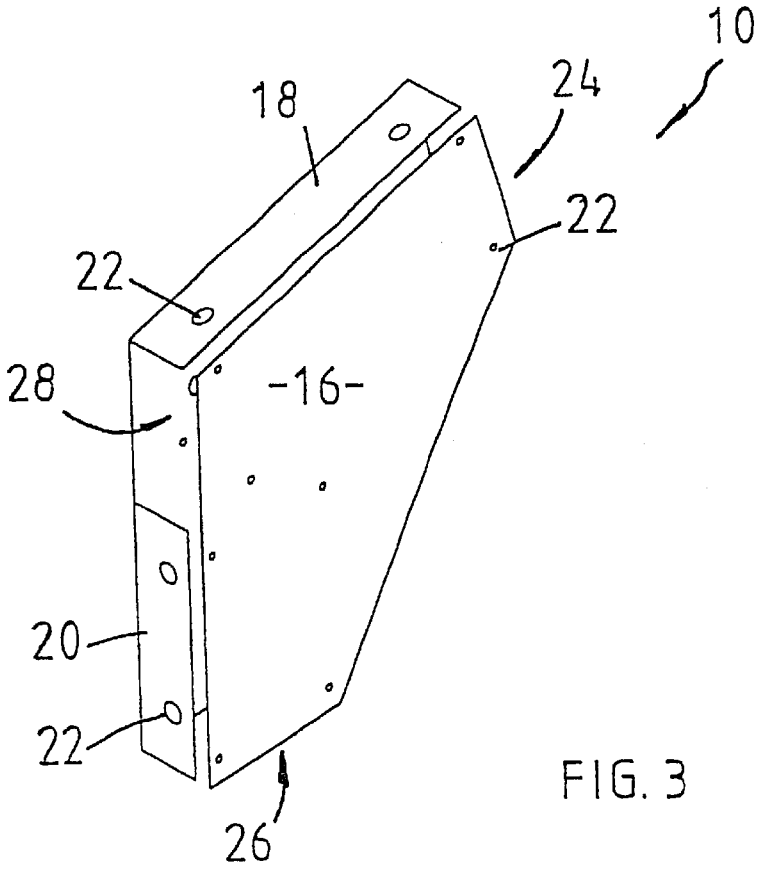
Figure 6:
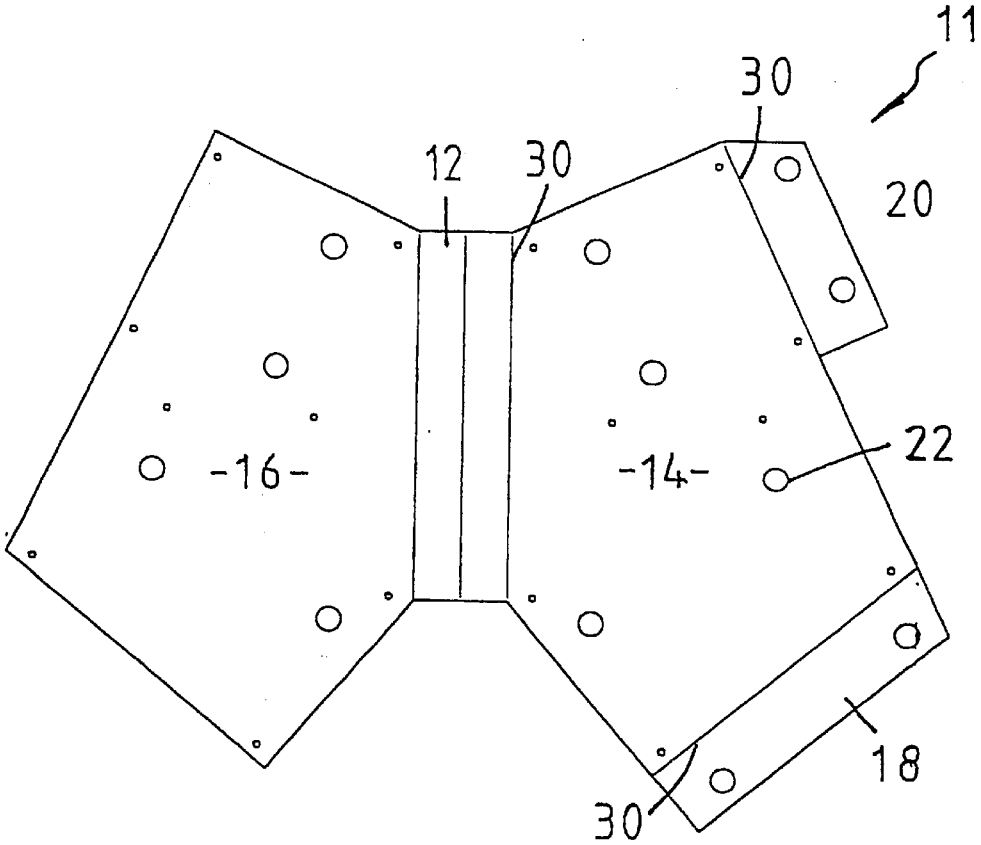
FIG. 6 is a plan view of an embodiment of a blank for forming the knee jointing device shown in FIG. 1.

FIG. 6 is a blank 11 of steel plate for forming the knee jointing device 10. The blank 11 has foldlines 30 allowing easy bending along the foldlines 30 to from the device 10 as shown in FIGS. 2 and 3. The apertures 22 are also predrilled in the blank 11.

Figure 7:
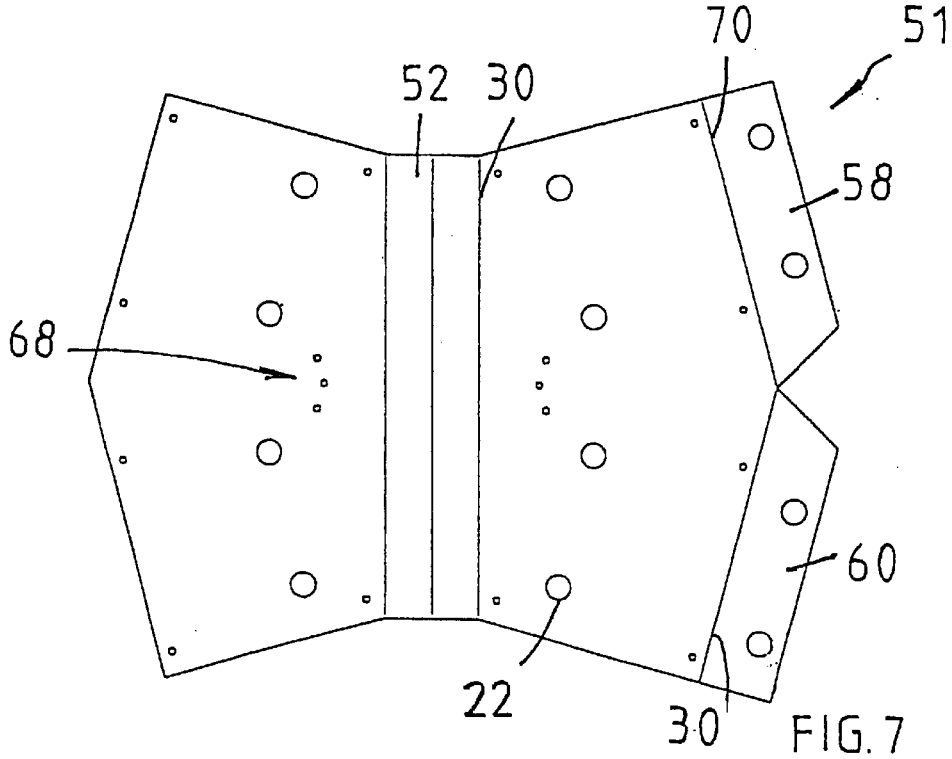
FIG. 7 is a plan view of an embodiment of a blank for forming the apex jointing device shown in FIG. 1.

FIG. 7 is a blank 51 of steel plate for forming the apex jointing device 50. This blank 51 also has foldlines 30 allowing easy bending for forming the apex jointing device 50, and predrilled apertures 22 and observation holes 68.

Figure 8:
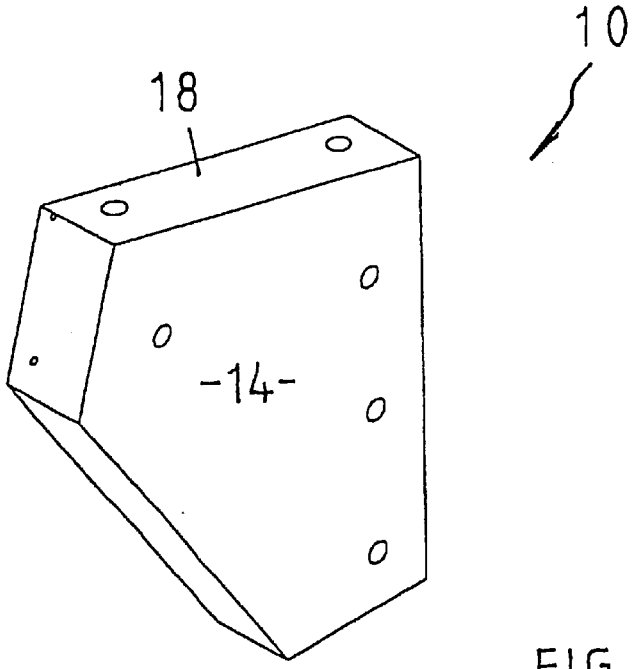
FIGS. 8 and 9 are respective isometric view from front and back of another embodiment of the knee jointing device according to the present invention.
Figure 9:
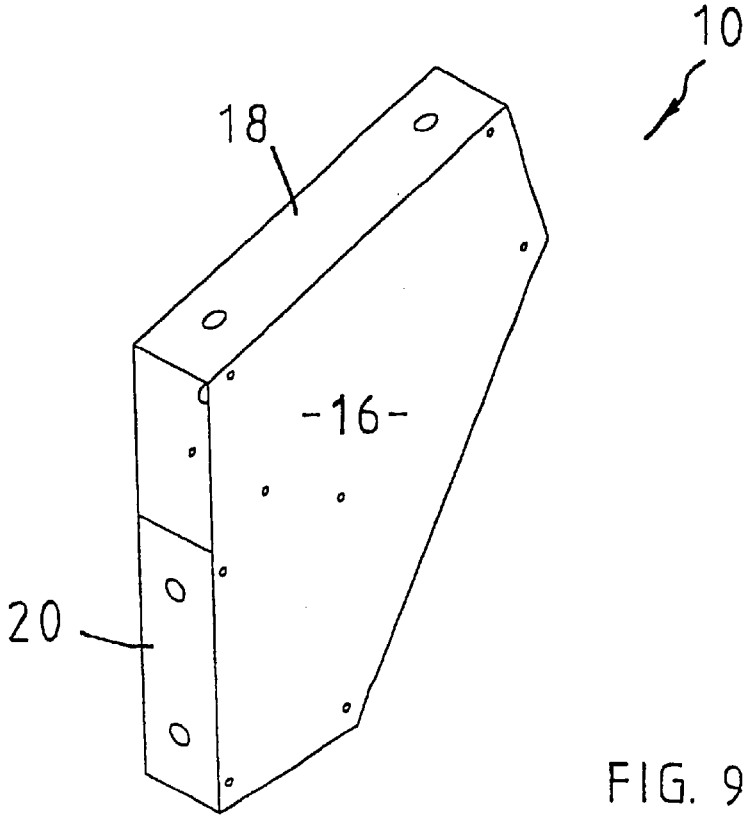

FIGS. 8 and 9 show another embodiment of the knee jointing device 10 in which the skirt elements 18 and 20 extend to the flange portion 16.

Figure 10:
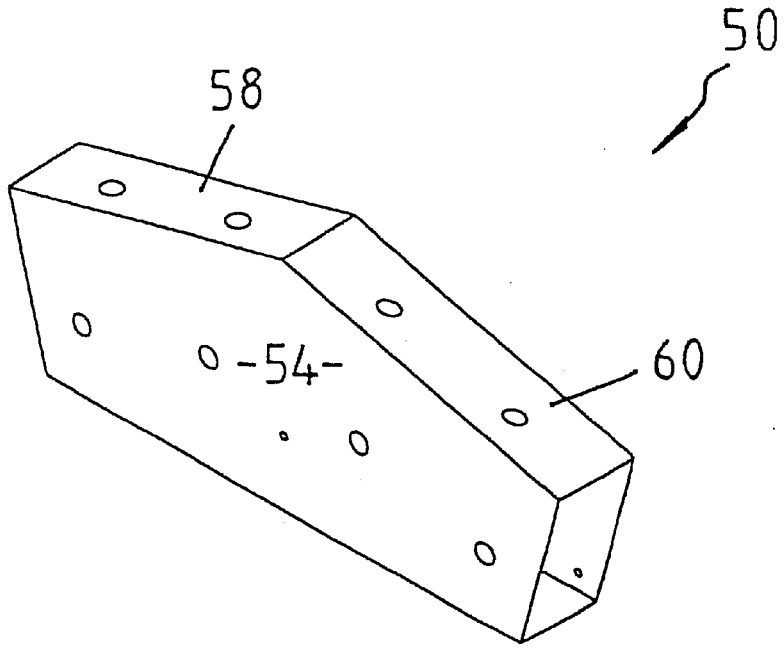
FIGS. 10 and 11 are respective isometric view from front and back of another embodiment of the apex jointing device according to the present invention.
Figure 11:
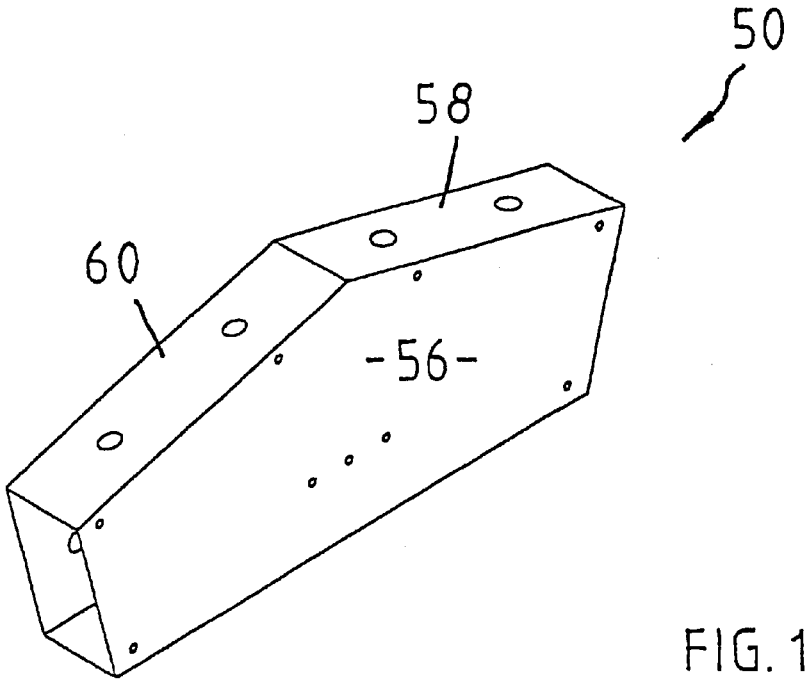

As for the knee jointing device 10 in FIGS. 8 and 9, the apex jointing device 50 in FIGS. 10 and 11 has its skirt elements 58 and 60 extend to the flange portion 56.

While not shown it should be understood that the devices 10 and 50 can be in the form of tubular sleeves with the skirt elements portions 1 8, 20 and 58, 60 formed integrally with respective flange portions 14, 16 and 54, 56.

Figure 12:
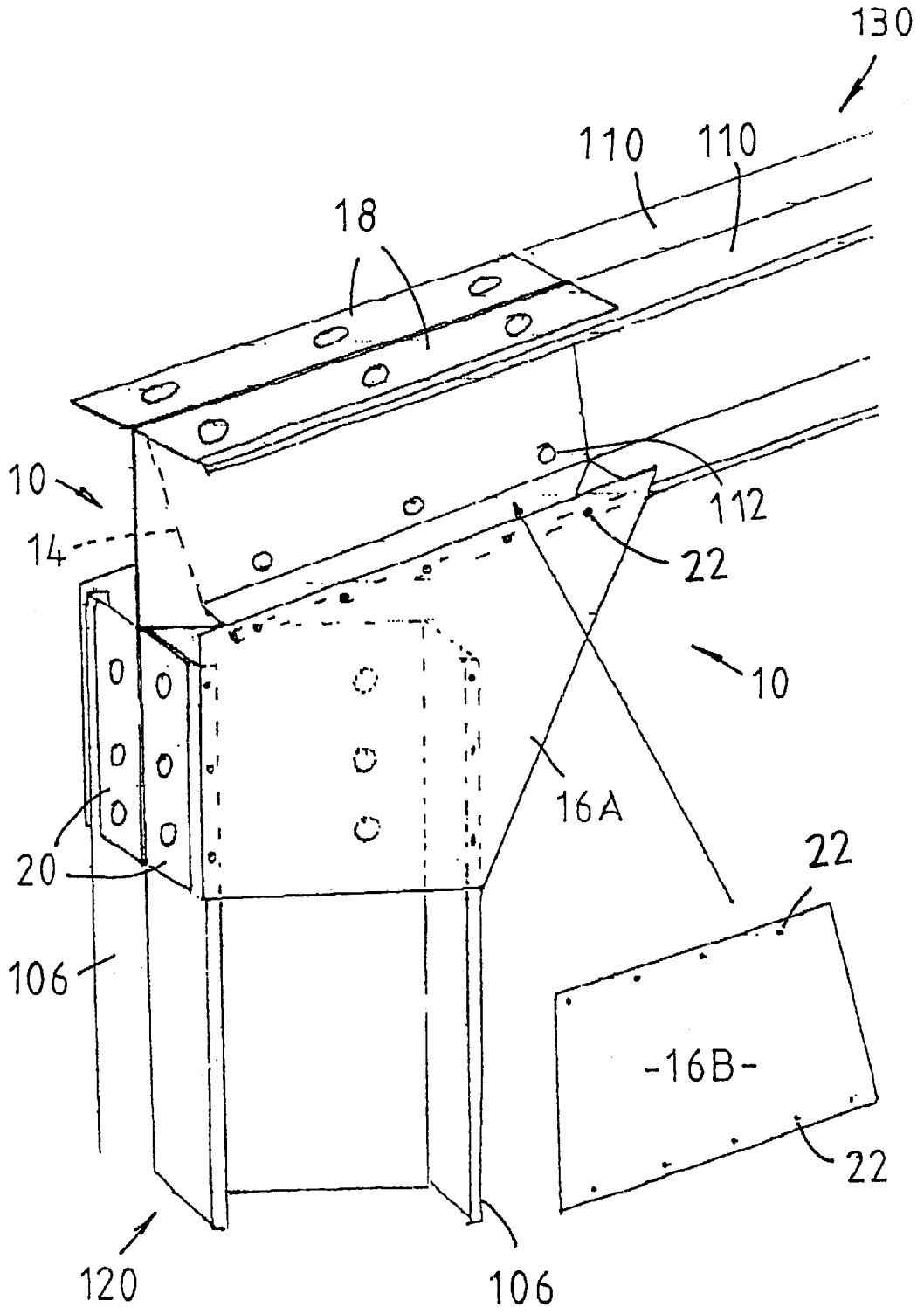
FIG. 12 is a perspective view of a partial building structure employing a further embodiment of the knee jointing device according to the present invention.

In FIG. 12, the knee jointing device 10 is modified for joining upright members 120 and roof truss member 130. The upright member 120 has two C-section section leg purlins 106 positioned back to back and the roof truss member 130 also has two roof truss purlins 110 position back to back.

Two knee jointing devices 10 are employed for joining the members 120 and 130. As can be seen the devices 10 are positioned back to back in between the leg purlins 106 and in between the roof truss purlins 110.

The flange portion 16 in this case is formed of two parts 16A and 16B. Part 16A is integrally formed with the gusset portion 12 and part 16B is a row of holes 22 for removably fixing to part 16A by screws (not shown). For this purpose, part 16A is also provided with a row of corresponding holes 22. The part 16B as shown is separated from the part 16A so that an operator may have access holes 112 to apply fixing means to fix the flange portions 14 to the roof truss purlins 110.

The part 16B has additional holes 22 for fixing to the roof truss purlins 110.

Whilst the above has been given by way of illustrative example of the present invention many variations and modifications thereto will be apparent to those skilled in the art without departing from the broad ambit and scope of the invention as herein set forth.

What is claimed is:

1. A jointing device adapted for a building structure having elongate members, the device comprises a gusset portion and spaced parallel flange portions each extending from an edge of the gusset portion and forming only a single cavity there between, the device further comprises a first opening having a first central axis, and a second opening having a second central axis; the spaced flange portions having a shape that said first axis and said second axis are at an angle to each other; the first opening being arranged adjacent to an end of the gusset portion and in communication with the cavity and the second opening being arranged adjacent to the opposite end of the gusset portion and in communication with the cavity; the cavity being adapted to receive an end section of one of the elongate members through said first opening and in line with said first axis, and an end section of another of the elongate members through said second opening and in line with said second axis, for joining by fixing the one and another elongated members to the jointing device; wherein said one and another elongate members are solid, hollow or a combination thereof and are in the form of a C or U shaped sections, or T or I shaped sections, or a combination thereof; and said device is formed from a single blank with foldlines at respective edges of a section forming said gusset portion and the blank is configured with spaced sections bent along said foldlines to form said gusset portion and said flange portions, and wherein at least one of the flange portions has one or more skirt elements formed remotely from said gusset portion and extending in a direction towards the opposite flange portion.

2. The device as claimed in claim 1 wherein said at least one flange portion has two skirt elements arranged for, abutting respective said one and another elongate members when joined by the device.

3. The device as claimed in claim 1 wherein the device is formed with means for facilitating fixing to the elongate members, said facilitating means includes guide holes through which fixing means extend to fix to the elongate members.

4. The device as claimed in claim 1 wherein the gusset portion extends to the openings so that the one and another elongate members when joined by the device are in contact with free ends of the gusset portions.

5. The device as claimed in claim 1 wherein said elongate members having two of said C or U shaped sections, or T or I shaped sections positioned back to back.

6. The device as claimed in claim 1 wherein one or each of the flange portions having a part which can be removed for providing access to fixing the device to or removing the device from one of the elongate members.

7. The device as claimed in claim 1 wherein the device has a third opening in alignment with the first opening so that the elongate member extending through the first opening can extend outwardly through the third opening to form an eave support structure.

8. The device as claimed in claim 1 wherein one or both said flange portions having one or more observation holes for checking the elongate members in the cavity thereof.

9. A building structure comprising at least one pair of spaced upright elongate members and one or more roof truss elongate members spanning the or each pair of the upright elongate members, wherein each of the upright elongate members is joined to the or each said roof truss elongate members by a jointing device as claimed in claim 1.

10. The building structure as claimed in claim 9 wherein said building structure includes two or more roof truss elongate members and adjacent roof truss elongate members being joined by the device.

11. The building structure as claimed in claim 9 wherein the structure is in the form of a portal frame for a carport, garage, shed, dwelling or other buildings.

12. A jointing device as claimed in claim 1, which is of one-piece construction and which has a rectangular cross-sectional configuration having four corners, three of said corners being formed by bendin said one-piece construction and the fourth of said four corners being defined by the meeting of an edge of a said skirt element and an edge of a said flange portion.

* * * * *

UNITED STATES PATENT AND TRADEMARK OFFICE

CERTIFICATE OF CORRECTION

PATENT NO. : 6,327,823 B1
DATED : December 11, 2001
INVENTOR(S) : Philip John Emms It is certified that error appears in the above-identified patent and that said Letters Patent is hereby corrected as shown below:

Title page,
Insert Item [30] as follows:

-- Foreign Application Priority Data
Sep. 10, 1998 (AU) Australia . . . . . PP5794 --.

Signed and Sealed this

Second Day of July, 2002

*Attest:*

*Attesting Officer*

JAMES E. ROGAN
*Director of the United States Patent and Trademark Office*